United States Patent [19]

Gijrath et al.

[11] Patent Number: 4,670,687

[45] Date of Patent: Jun. 2, 1987

[54] COLOR DISPLAY TUBE HAVING PIVOTABLE SUSPENSION MEANS FOR COLOR SELECTION ELECTRODE

[75] Inventors: Johannes H. N. Gijrath; Johannus A. Vennix, both of Eindhoven, Netherlands

[73] Assignee: U.S. Philips Corporation, New York, N.Y.

[21] Appl. No.: 742,660

[22] Filed: Jun. 10, 1985

Related U.S. Application Data

[63] Continuation of Ser. No. 365,059, Apr. 2, 1982, abandoned.

[30] Foreign Application Priority Data

May 4, 1981 [NL] Netherlands ..... 8102182

[51] Int. Cl.[4] ..... H01J 29/07

[52] U.S. Cl. ..... 313/404; 313/407

[58] Field of Search ..... 313/402, 404, 405, 406, 313/407, 408

[56] References Cited

U.S. PATENT DOCUMENTS

| | | | |
|---|---|---|---|
| 3,890,526 | 6/1975 | Palac | 313/404 X |
| 3,986,071 | 10/1976 | Groot | 313/404 |
| 3,986,072 | 10/1976 | Adamski | 313/404 |
| 4,455,505 | 6/1984 | Ragland, Jr. | 313/404 |

*Primary Examiner*—Leo H. Boudreau
*Assistant Examiner*—K. Wieder
*Attorney, Agent, or Firm*—Robert J. Kraus

[57] ABSTRACT

A color selection electrode in a color display tube is suspended in the corners of the upright edge of the tube's display window by means of flat resilient elements pivotally connected to the corners of the color selection electrode. The flat resilient elements are urged against respective supporting elements in the corners of the display window by separate spring elements.

9 Claims, 6 Drawing Figures

COLOR DISPLAY TUBE HAVING PIVOTABLE SUSPENSION MEANS FOR COLOR SELECTION ELECTRODE

This is a continuation of application Ser. No. 365,059, filed Apr. 2, 1982, now abandoned.

BACKGROUND OF THE INVENTION

The invention relates to a colour display tube comprising an envelope having a substantially rectangular display window and a substantially rectangular colour selection electrode which has a large number of apertures. The color selection electrode is suspended from supporting elements each connected in a corner of the display window by means of suspension means comprising a flat resilient element connected to the colour selection electrode. Each flat resilient element extends substantially perpendicularly to the electron beams deflected towards the respective corner. Each supporting element cooperates with a flat resilient element of the suspension means by means of a stud connected to one of the cooperating elements, said stud extending partly through an aperture provided in the other cooperating element.

Such a colour display tube is described in prior non-prepublished Netherlands Patent Application Nos. 8004173 corresponding to U.S. Pat. No. 4,387,321; and 8004174 corresponding to U.S. Pat. No. 4,358,702.

In the suspension described in Patent Application No. 8004173 the supporting element is formed by a pin which is sealed in the corner of the display window and at the free end of which the stud is present. The axis of the stud is substantially perpendicular to the plane of the flat resilient element. Near the end remote from the colour selection electrode an aperture is provided in the flat resilient element. The colour selection electrode is suspended in the display window by placing the flat resilient elements with their apertures on the studs of the pins. The studs project partly through the apertures. According to a further embodiment, the position of the apertures in the flat resilient elements may be adapted to the position of the studs by providing the flat resilient elements with slot-shaped apertures and placing apertured plates for the studs on the resilient elements. After suspending the colour selection electrode the plates are permanently connected to the flat resilient elements.

In the suspension described in Patent Application No. 8004174 the supporting element connected in the corner of the display window has a flat portion which is substantially perpendicular to the electron beams deflected towards the relevant corner. An aperture is provided in said flat portion. Near the end remote from the colour selection electrode the flat resilient element has a stud the axis of which is perpendicular to the plane of the flat resilient element. The colour selection electrode is suspended in the display window by placing the flat resilient elements with their studs in the apertures of the supporting elements, the studs projecting partly through the apertures. In this suspension also, according to a further embodiment, the position of the studs may be adapted to the position of the apertures by providing the studs on loose plates, which plates are permanently secured to the flat resilient elements after suspending the colour selection electrode.

In both above-mentioned Patent Applications the flat resilient element fulfils three functions. First, the flat resilient element causes the colour selection electrode to move in a direction towards the window in the case of expansion. When the colour selection electrode expands, a smaller distance is necessary between the colour selection electrode and the display window to maintain a colour pure picture. Since each of the flat resilient elements is substantially perpendicular to the electron beams deflected towards the respective corner, the colour selection electrode moves towards the display window as a result of the spring action of the flat resilient elements. Second, the flat resilient elements fix the position of the colour selection electrode with respect to the display window. Third, the flat resilient elements ensure the maintenance of said position of the colour selection electrode. For this purpose the flat resilient elements exert a certain clamping pressure on the supporting elements so that in the case of vibrations any change in the position of the flat resilient elements changes with respect to the supporting elements. In order to be able to exert a sufficiently large clamping pressure the flat resilient elements should be comparatively thick.

During manufacture, the display tube is heated to approximately 400° C. while adhering the display window to the cone and while evacuating the display tube. During this heating the colour selection electrode expands and, as a result of the deflection of the flat resilient elements, moves towards the display window. It has been found, however, that after cooling the display tube, the flat resilient elements do not always return to their original position, which causes displacements of the colour selection electrode and consequently colour defects in the observed picture.

SUMMARY OF THE INVENTION

It is therefore an object of the invention to provide a suspension of a colour selection electrode in a colour display tube by which the position of the colour selection electrode with respect to the display window is better ensured. For that purpose, according to the invention, a colour display tube of a kind mentioned in the opening paragraph is characterized in that each flat resilient element is urged on the respective supporting element by means of a second resilient element which is connected at one end to the colour selection electrode and which at its other end is connected near the end of the flat resilient element remote from the colour selection electrode, and in that each flat resilient element is connected to the colour selection electrode so as to be substantially pivotable.

The invention is based on the experimentally gained recognition that the flat resilient elements change their shape permanently during the temperature treatments during the manufacture of the display tube. As a result of the high temperature the stresses in the deflected flat resilient elements are released so that the elements deform plastically. After cooling, the flat resilient elements maintain their deflected shape and therefore the colour selection electrode does not return to its position. According to the invention the original functions of the flat resilient elements are separated. First, the flat resilient elements again fix the position of the colour selection electrode with respect to the display window. Second, the flat resilient relements cause the colour selection electrode to move towards the display window upon expansion. Each flat resilient element engages the associated supporting element without clamping pressure. Since the flat resilicnt elements are connected to the colour selection electrode so as to be substantially pivotable, the flat resilient elements upon expansion of the colour selection electrode do not deflect over their full length but pivot about the end connected to the colour selection electrode. Second resilient elements ensure the maintenance of the position of the flat resilient elements with respect to the supporting elements. A second resilient element urges the flat resilient element onto the pin or, alternatively the stud of the flat resilient element into the aperture of the supporting element without influencing the position of the colour selection electrode.

In one embodiment, the second resilient element is a wire spring. The advantage of a wire spring is that it has a comparatively flat spring characteristic, that is to say that small differences in deflection of the wire spring only result in small variations in the resilience. Because of this the forces with which the flat resilient elements are urged onto the supporting elements are substantially independent of tolerances in the dimensions of the colour selection electrode, tolerances in the position of the supporting elements, and tolerances in the dimensions of the display window.

In another embodiment the point of engagement of the second resilient element at the end remote from the colour selection electrode coincides substantially with the axis of the stud. As a result of this, the second resilient element is prevented from exerting a torque on the flat resilient element so that the flat resilient element might become warped with respect to the supporting element.

In still another embodiment, the flat resilient elements have reinforcements extending substantially in the longitudinal direction of the flat resilient elements. The reinforcements add rigidity to each flat resilient element such that upon expansion of the colour selection electrode the flat resilient element is prevented from deflecting over its entire length and is prevented from being warped by a second resilient element.

In yet another embodiment, the width of a flat resilient element increases from the free end towards the colour selection electrode. As a result of the wide ends of the flat resilient elements on the side facing the colour selection electrode, the flat resilient elements have a larger rigidity perpendicularly to the longitudinal direction of the flat resilient elements. As a result of this the flat resilient elements are less sensitive to vibrations.

In another embodiment, the colour selection electrode comprises in each corner a lug which limits the movement of the associated flat resilient element. Upon disassembling and again assembling the colour selection electrode in the so-called flow coating the lug prevents a flat resilient element from being warped outwardly by a second resilient element. In the case in which the supporting element is formed by a pin sealed in the upright edge of the display window and the flat resilient element has an aperture, the lug on the side remote from the colour selection electrode may have a substantially V-shaped notch. This notch, when inserting the colour selection electrode on the pins, fulfils a guiding function so that the apertures in the flat resilient elements easily fall over the studs on the sealed pins.

BRIEF DESCRIPTION OF THE INVENTION

The invention will now be described by way of example with reference to the accompanying drawing, in which:

FIG. 1 is a sectional view of a colour display tube,

FIG. 2*a* is a perspective illustration of a first embodiment of a suspension of a colour selection electrode in a corner of the display window according to the invention, FIG. 2*b* is an elevation of the suspension means shown in FIG. 2*a*, FIG. 3 is a sectional view taken on the line III—III of FIG. 2*a*, FIG. 4*a* is a perspective illustration of a second embodiment of a suspension of a colour selection electrode in a corner of the display tube according to the invention, and FIG. 4*b* is a sectional view taken on the line IV—IV of FIG. 4*a*.

DESCRIPTION OF THE PREFERRED EMBODIMENTS

Figure 1:
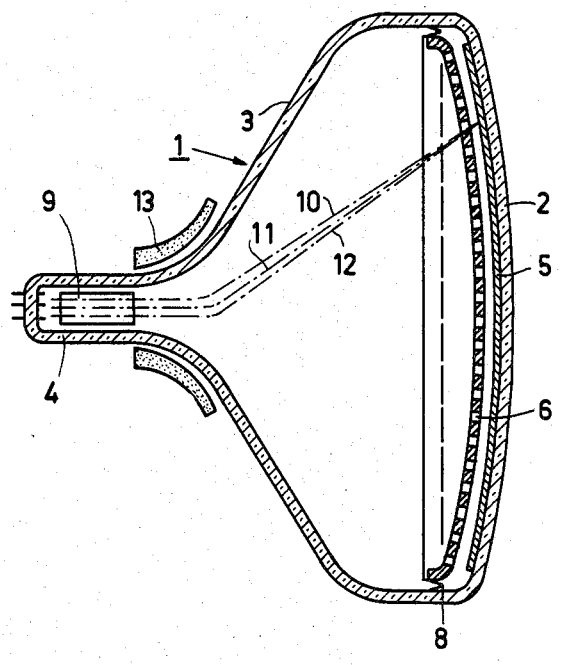

The colour display tube 1 shown in FIG. 1 is formed by a glass envelope which has a substantially rectangular display screen 2, a cone 3 and a neck 4. A pattern of luminescent phosphors 5 luminescing in the colours red, green and blue, is provided on the display screen 2. At a short distance from the display screen 2 a colour selection electrode 6 having a large number of apertures is suspended by means of diagrammatically shown suspension means 8 connected in the corners of the upright edge. A system of electron guns 9 for generating three electron beams 10, 11 and 12 is mounted in the neck 4 of the tube. These beams are deflected by means of a system of deflection coils 13 placed around the tube 1 and said beams intersect each other substantially at the level of the colour selection electrode 6, after which each of the electron beams impinges on one of the three phosphors provided on the display screen 2.

Figure 2B:
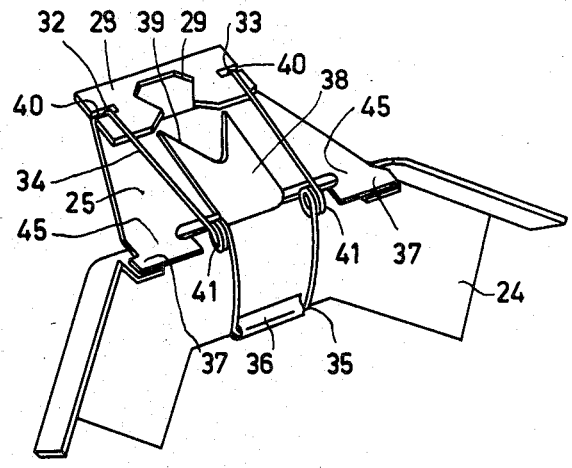
Figure 2A:
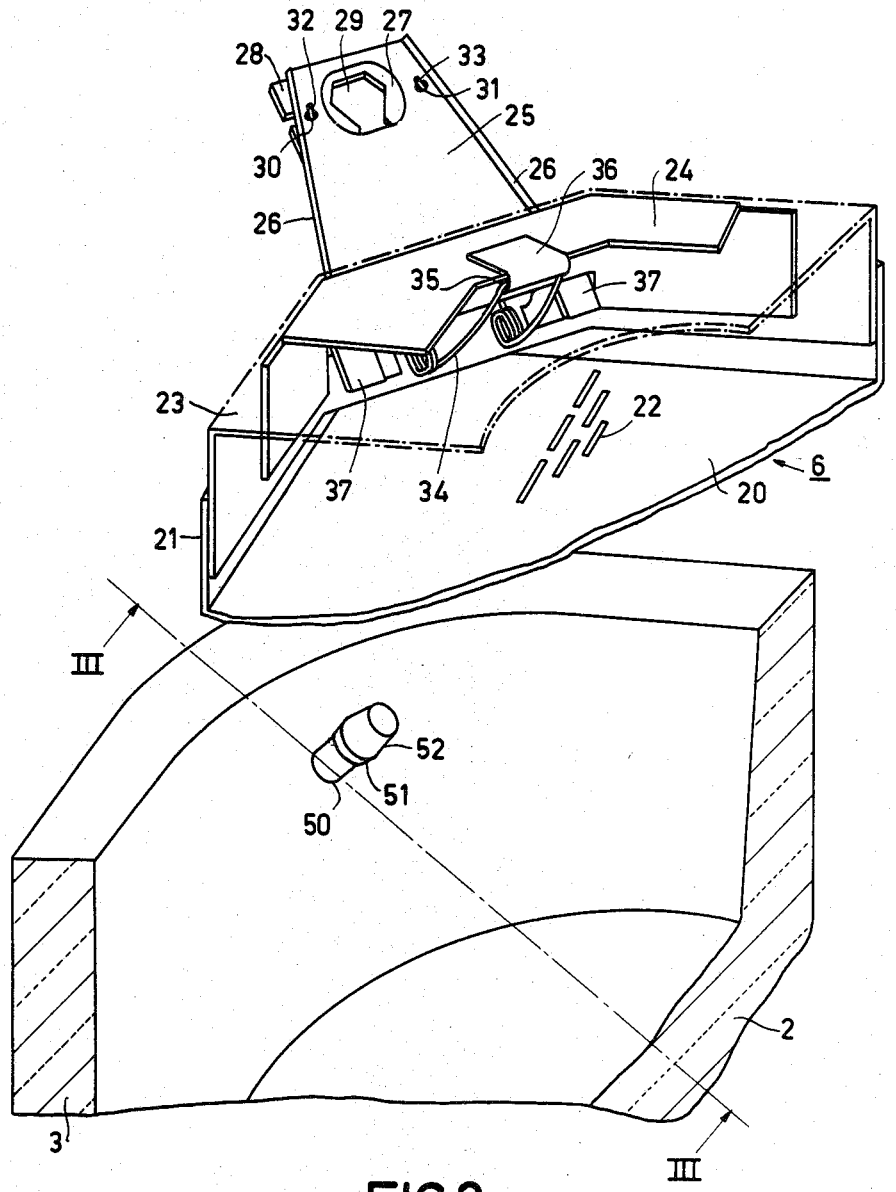

FIG. 2*a* is a perspective exploded view of a corner of the display window. A metal pin 50 is sealed in the corner of the upright edge 3 of the display window 2. The pin 50 makes such an angle with the upright edge 3 that the pin 50 is substantially perpendicular to the plane of the flat resilient element 25 connected to the colour selection electrode 6. At its free end the pin 50 has a mandril 51 which comprises a conical stud 52.

The colour selection electrode 6 is formed by a thin mask sheet 20 which has a large number of apertures 22 and an upright edge or skirt 21. A diaphragm 23 shown partly in broken lines is connected to the upright edge 21 and prevents reflection of electrons at the upright edge 21. In order to avoid differences in expansion between the mask sheet 20 and the diaphragm 23, both are manufactured from the same materials and are of approximately the same thickness. A supporting strip 24 is connected in the corner of the diaphragm 23. A thin flat resilient element 25 is connected to two small surfaces 37 of said supporting strip 24. The flat resilient element 25 encloses such an angle with the longitudinal axis of the tube that the flat resilient element 25 is substantially perpendicular to the electron beams deflected towards the respective corner. The flat resilient element 25 has a substantially triangular shape having a wide base at the end nearest the colour sclection electrode. As a result of this the flat resilient element 25 has high rigidity in a direction perpendicular to the respective diagonal of the display screen, as a result of which the flat resilient element 25 is relatively sensitive to vibrations. The flat resilient element 25 further comprises bent-over edges 26 which reinforce the flat resilient element 25 in its longitudinal direction. Near the end remote from the colour selection electrode 6 a slot-shaped aperture 27 is provided in the flat resilient element 25. This aperture 27 is covered partly by a plate 28 having aperture 29 connected to the element 25. The function of the plate 28 will be described in greater detail hereinafter. Two holes 30 and 31 are provided in the flat resilient element 25 beside the slot-shaped aperture 27, through which holes extend the bentover ends 32 and 33 of wire spring 34 visible only partly in the Figure. The other end 35 of the wire spring 34 is clamped against a bent-over lug 36 which is connected to the supporting strip 24.

For a better understanding, FIG. 2*b* is a perspective view of an elevation of the supporting strip with suspension means, in which Figures the same components are referred to by the same reference numerals as in FIG. 2*a*. The flat resilient element 25 is connected to the supporting strip 24 only at two small surfaces 37, a narrow portion 45 being present above each surface 37. When the colour selection electrode expands, only these narrow portions 45 deflect, while the remaining part of the flat resilient element 25 remains flat so that the flat resilient element 25 pivots substantially about the end connected to the colour selection electrode. The plate 28 has two notches 40 through which the bent-over ends 32 and 33 of the wire spring 34 extend. At the level of the end of the flat resilient element 25 nearest the colour selection electrode 6 a number of loops 41 are wound in the wire spring 34 so that the wire spring 34 can be tensioned. The end 35 of the wire spring 34 is clamped behind the lug 36 connected to the supporting strip 24. In this manner the wire spring 34 is connected so as to be tensioned between the supporting strip 24 and the end of the flat resilient element 25 remote from the colour selection electrode 6. Otherwise the wire spring 34 is entirely free from the flat resilient element 25. The supporting strip 24 further comprises a lug 38 formed integral and limiting the movement of the flat resilient element 25. The lug 38 has a V-shaped notch 39 which fulfils a function in the manufacture of the display tube.

Figure 3:
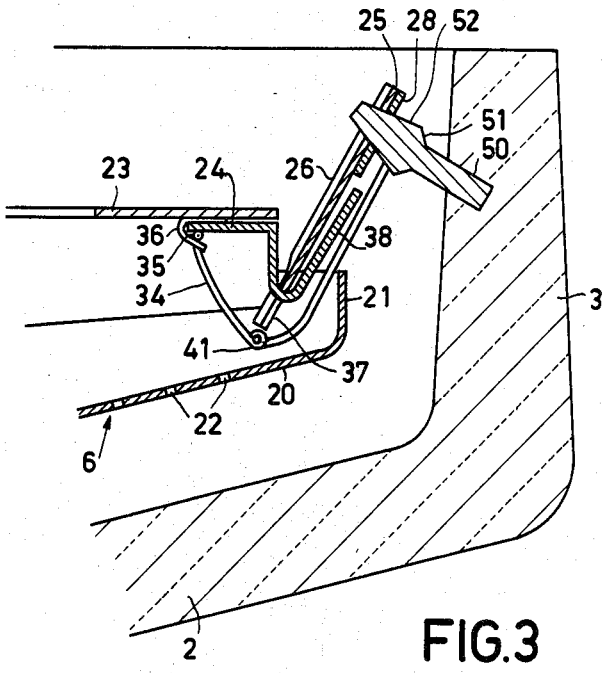

FIG. 3 is a sectional view taken on the line III—III of FIG. 2*a* with the colour selection electrode in the assembled condition. The colour selection electrode 6 is suspended in the display window by placing the resilient elements 25 and the plates 28 with their apertures on the conical studs 52 of the pins 50. The position of the colour selection electrode 6 with respect to the display window 2 is fully fixed in this manner by the flat resilient elements 25.

The flat resilient element 25 engages the stud 52 of the pin 50 without tension. Since it is no longer necessary for the flat resilient element 25 to perform a clamping pressure to maintain its position relative to the supporting element, the flat resilient element 25 may be thin. The flat resilient element 25 is urged on the pin 50 by the tensioned wire spring 34. This wire spring 34 ensures that after the occurence of vibrations the resilient element 25 always resumes the same position on the stud 52 of the pin 50. As a result changes in the position of the flat resilient element 25 which would lead to positional vibrations of the colour selection electrode 6 and colour defects in the observed picture are avoided. The wire spring 34 has a comparatively flat spring characteristic, which means that small differences in the deflection of the wire springs 34 cause substantially no differences in the forces with which the flat resilient elements 25 are urged on the studs 52. As a result of this the forces with which the flat resilient elements 25 are urged on the studs 52 are substantially independent of tolerances in the dimensions of the colour selection electrode 6 and of tolerances in the dimensions of the display window 2. In order to prevent the wire spring 34 from warping the flat resilient element 25 and thus producing a pretension in the element 25, the flat resilient element 25 comprises bent-over edges 26 which reinforce the element 25. Instead of bent-over edges the reinforcements may also consist of ridges provided substantially in the longitudinal direction of the resilient element. The holes 30 and 31 in which the bent-over ends 32 and 33 of the wire spring 34 are hooked are in alignment with the centre of the aperture 27 (see FIG. 2*a*). The point of engagement of the tensile forces of the wire spring 34 thus coincides with the axis of the stud 52, so that the wire spring 34 cannot exert a moment on the flat resilient element 25 as a result of which the position of the element 25 with respect to the stud 52 might change. The flat resilient element 25 is secured to the colour selection electrode 6 at such an angle as to be substantially perpendicular to the electron beams deflected towards the corner of the display window 2. Upon expansion of the colour selection electrode 6 a smaller distance is necessary between the colour selection electrode 6 and the display window 2 to maintain a colour true picture. Since the flat resilient elements 25 are connected to the colour selection electrode 6 so as to be substantially pivotable, the colour selection electrode 6 upon expansion moves in a direction towards the display window 2. As a result of the pivoting action of the flat resilient elements 25, they do not deflect over their full length upon expansion of the colour selection electrode 6. When the colour selection electrode 6 expands, only the narrow portions 45 of the flat resilient elements 25 deflect (see FIG. 2*b*). Since the flat resilient elements 25 are thin and engage studs 52 without clamping pressure, the stresses occurring in the narrow portions 45 upon deflection are small. As a result of this, plastic deformation of the narrow portions 45 does not occur during the thermal treatments to which the display tube is subjected during the manufacture, so that after cooling, the flat resilient elements 25 again spring back over the narrow portions 45 and the colour selection electrode 6 again resumes its original position. The bent-over edges 26 of the flat resilient elements 25 ensure that upon expansion of the colour selection electrode 6 the elements 25 pivot only about the end connected to the colour selection electrode 6 and do not deflect over the length of the flat resilient elements 25.

It is to be noted that other resilient elements having a flat spring characteristic may also be used instead of wire springs. Such elements would be connected at one end to the colour selection electrode and at the other end urge the flat resilient elements onto the studs.

The function of the plate 28 is associated with the manner of manufacturing the display tube, which occurs as follows. The pins 50 are sealed in the corners of the upright edge 3 of the display window 2. The diaphragm 23 with the flat resilient elements 25 already connected in the corners with wire springs 34 and loose plates 28 is placed on the studs 52 of the pins 50. The lug 38 ensures that in the disassembled condition the flat resilient element 25 does not flip aside as a result of the tensile force of wire spring 34. During assembly the V-shaped notch 39 in the lug 38 ensures that upon inserting the colour selection electrode 6 the studs 52 easily slide into the apertures 29 in the plates 28. Each plate 28 has two notches 40 through which the bentover ends 32 and 33 of the wire spring 34 extend (see FIG. 2*b*). The bentover ends 32 and 33 of the wire spring 34 journal the plate 28 so that the aperture 29 is kept at the correct level with respect to the slot-shaped aperture 27 in the flat element 25 and that the plate 28 can move relative to the flat resilient element 25. After mounting on the studs 52, the plates 27 are secured to the resilient elements 25. As a result of this the position of the aperture 29 accurately corresponds to the position of the conical stud 52. When no separate plates 28 are used, deformations of the colour selection electrode 6 may occur as a result of differences in the position of the studs 52 and the apertures 27 in the flat resilient elements 25. After having suspended the diaphragm or mask ring 23 with the resilient elements 25 in the display window 2 in the manner described above, the mask sheet 20 is laid in the display window 2 with the interposition of a spacing jig, after which the diaphragm 23 is welded to the upright edge 21 of the mask sheet 20.

Another embodiment will be described with reference to FIGS. 4*a* and 4*b*. FIG. 4*a* is an exploded perspective view of a corner of the display window, in which Figure corresponding components are referred to by the same reference numerals as in FIG. 2*a*. At the end of the flat resilient element 25 remote from the colour selection electrode 6 a plate 28 is secured which has a conical stud 60 which is shown in broken lines in the Figure. The stud 60 is perpendicular to the plane of the flat resilient element 25. A supporting element 61 having two projections 62 is sealed in the corner of the upright edge 3 of the display window 2. The supporting element 61 comprises a part 63 extending parallel to the flat resilient element 25 and having a triangular aperture 64. The colour selection electrode 6 is suspended in the display window 2 by placing the studs 60 in the apertures 64.

Figure 4B:
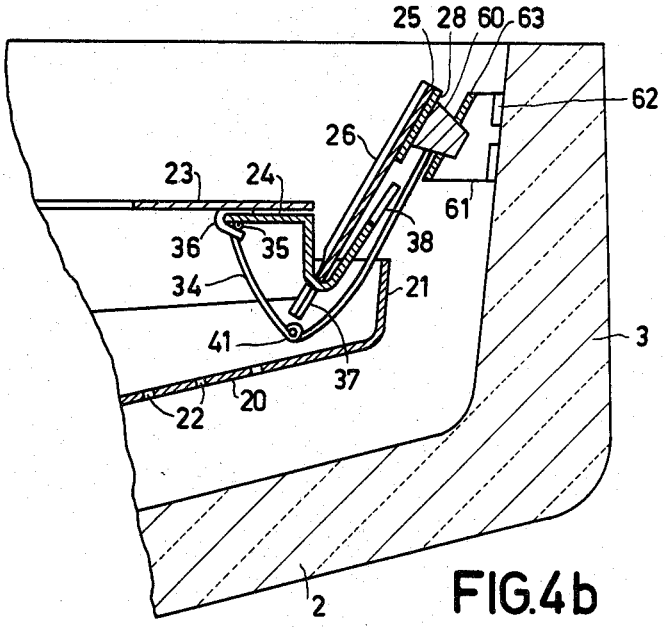
Figure 4A:
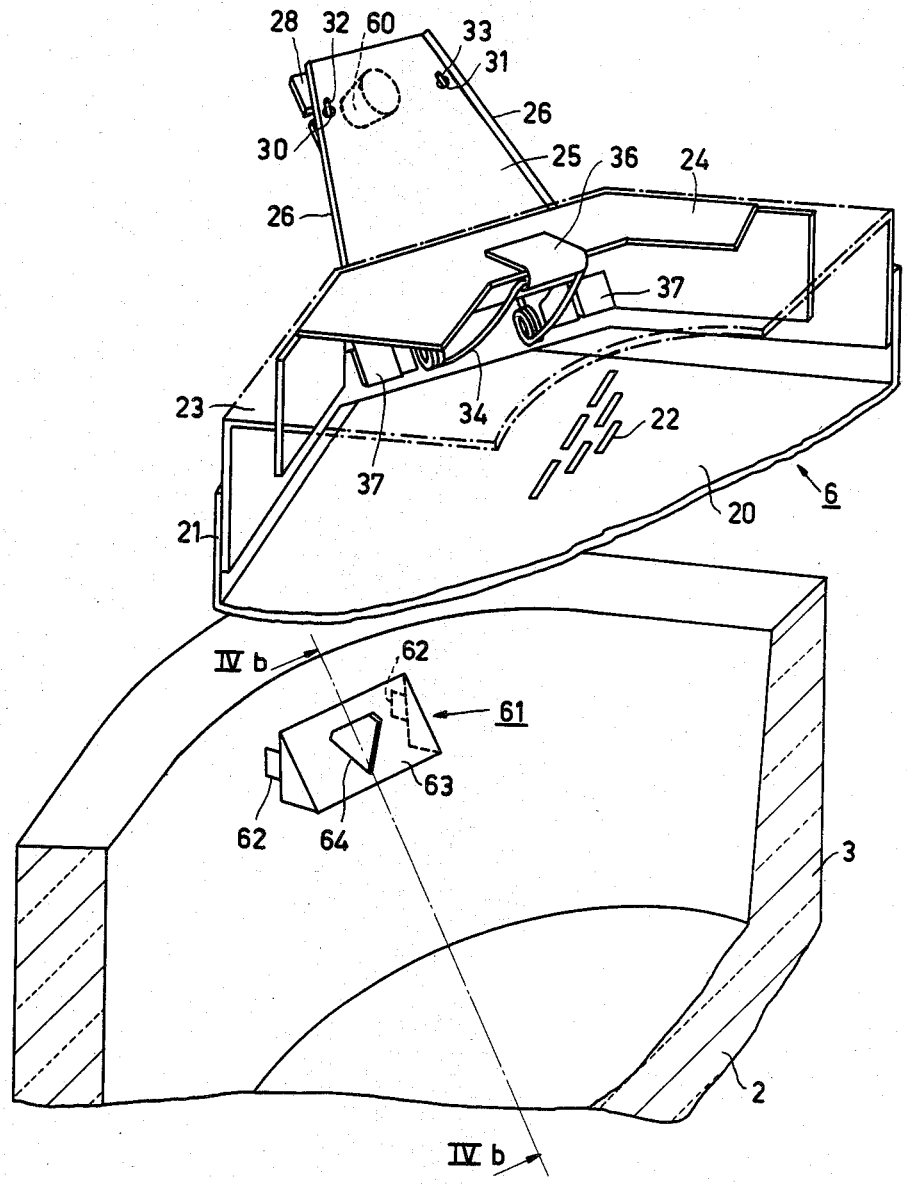

FIG. 4*b* is a sectional view taken on the line IV—IV of FIG. 4*a* with the colour selection electrode in the assembled condition. The position of the colour selection electrode 6 with respect to the display window 2 is again maintained because the wire springs 34 urge the stud 60 into the aperture 64 of the supporting elements 61. Instead of the supporting elements shown, other supporting elements may of course also be used, as described in the already mentioned Netherlands Patent Application No. 8004174.

What is claimed is:

1. In a color display tube including an envelope having a rectangular display window provided with supporting elements disposed in respective corners, a rectangular color selection electrode including a supporting means attached to each corner, suspension means attached to respective ones of the supporting means for suspending said electrode in the envelope, and means for directing an electron beam at the color selection electrode, each of said suspension means comprising:

a. a resilient element having flexible connection means at one end connected to the respective supporting means, said flexible connection means permitting pivotable movement of the resilient element relative to the color selection electrode, and having an end remote from the color selection electrode including means for removably engaging the respective supporting element, said resilient element being oriented substantially perpendicularly with respect to the electron beam when it is directed toward the respective corner and positioning the color selection electrode at a predetermined distance from the display window; and b. a spring element having one end attached to the respective supporting means, and another end attached to the remote end of the resilient element, said spring element urging the remote end of the resilient element toward the respective supporting element;

the flexible connection means and spring element of each suspension means collectively providing sufficient force to effect secure engagement of said suspension means with the respective supporting element;

said supporting means at each corner of the color selection electrode including a lug extending along one side of the respective resilient element to limit the distance the spring element can move the resilient element, said lug including an end remote from the color selection electrode including a substantially v-shaped notch for facilitating attachment of the resilient element to the respective supporting element.

2. In a color display tube including an envelope having a rectangular display window provided with supporting elements disposed in respective corners, a rectangular color selection electrode spaced from the display window, and means for directing an electron beam at the color selection electrode, suspension means at respective corners of the color selection electrode for removably attaching said electrode to the supporting elements, each of said suspension means comprising:

a. a supporting member affixed to the respective corner of the color selection electrode;

b. a resilient element having a flexible portion at one end affixed to the respective supporting member for permitting pivotable movement of the resilient element relative to the respective supporting member, and having an end remote from said supporting member including means for removably engaging the respective supporting element disposed in a corner of the display window, said resilient element being oriented substantially perpendicularly with respect to the electron beam when it is directed toward the respective corner and positioning the color selection electrode at a predetermined distance from the display window; and c. a spring element having one end attached to the respective supporting member, and another end attached to the remote end of the resilient element, said spring element urging the remote end of the resilient element toward the respective supporting element;

said flexible portion and said spring element, of each suspension means, collectively providing sufficient force to effect secure engagement of said resilient element with the respective supporting element, but said flexible portion by itself providing a force which is insufficient to effect plastic self-deformation at high temperatures experienced during manufacture of the display tube.

3. A color display tube as in claim 2 where the spring element is a wire spring.

4. A color display tube as in claim 2 or 3 where the spring element is attached to the remote end of the resilient element at a location adjacent to the center of the means for removably engaging the respective supporting element.

5. A color display tube as in claim 2 where the resilient element comprises a substantially flat element including longitudinally-extending reinforcements.

6. A color display tube as in claim 1 or 5 where the width of the resilient element increases with distance from the remote end.

7. A color display tube as in claim 2 where each supporting member includes a lug extending along one side of the respective resilient element to limit the distance the spring element can move the resilient element.

8. A color display tube as in claim 7 where each lug includes an end remote from the color selection electrode including a substantially v-shape notch for facilitating attachment of the resilient element to the respective supporting element.

9. A color display tube as in claim 2 where the resilient element is substantially flat and the flexible portion comprises a reduced-width extension of the resilient element.

* * * * *